US005664883A

United States Patent [19]

Tomassini

[11] Patent Number: 5,664,883

[45] Date of Patent: Sep. 9, 1997

[54] MIXER WITH ALTERNATING SIZED FLOW PASSAGES

[75] Inventor: Philip H. Tomassini, Biglerville, Pa.

[73] Assignee: Abbottstown Industries, Inc., Abbottstown, Pa.

[21] Appl. No.: 708,402

[22] Filed: Sep. 4, 1996

[51] Int. Cl.[6] ..... B01F 7/18

[52] U.S. Cl. ..... 366/325.93; 366/328.3

[58] Field of Search ..... 366/64, 65, 97, 366/98, 129, 262–265, 270, 325.9, 325.91, 325.93, 328.2, 328.3, 330.1, 330.4, 331, 342, 343; 416/231 R, 231 A, 231 B

[56] References Cited

U.S. PATENT DOCUMENTS

| | | | |
|---|---|---|---|
| 61,160 | 1/1867 | Chritton . | |
| 114,050 | 4/1871 | Schultdrees . | |
| 158,365 | 1/1875 | Finley . | |
| 216,780 | 6/1879 | Caldwell . | |
| 254,371 | 2/1882 | Puffer et al. | 366/325.93 X |
| 270,373 | 1/1883 | Bertling . | |
| 273,569 | 3/1883 | Marchand . | |
| 628,073 | 7/1899 | Cornelius . | |
| 820,254 | 5/1906 | Powell | 366/325.93 |
| 861,603 | 7/1907 | Newton . | |
| 1,048,523 | 12/1912 | Giddens . | |
| 1,253,536 | 1/1918 | Schneider | 366/325.93 X |
| 1,279,890 | 9/1918 | Lutkiewicz . | |
| 1,573,760 | 2/1926 | Black . | |
| 2,025,378 | 12/1935 | Croasdale . | |
| 2,027,297 | 1/1936 | Tramposch . | |
| 2,046,784 | 7/1936 | Krause . | |
| 2,520,577 | 8/1950 | Tooley . | |
| 2,572,375 | 10/1951 | Oertli | 366/325.93 X |
| 2,719,031 | 9/1955 | Morgan . | |
| 2,805,843 | 9/1957 | Block . | |
| 3,041,052 | 6/1962 | Dedoes . | |
| 3,158,359 | 11/1964 | Stiffler | 416/231 A X |
| 3,161,404 | 12/1964 | Jay . | |
| 3,622,129 | 11/1971 | Mazowski . | |
| 3,697,053 | 10/1972 | Will . | |
| 4,050,678 | 9/1977 | Smith | 366/130 |
| 4,065,107 | 12/1977 | Van Horbek | 366/343 |
| 4,083,653 | 4/1978 | Stiffler | 416/142 |
| 4,151,792 | 5/1979 | Nearhood | 99/348 |
| 4,160,602 | 7/1979 | Benz et al. | 366/162 |
| 4,175,875 | 11/1979 | Van Horbek | 366/343 |
| 4,339,992 | 7/1982 | Kurland | 99/348 |
| 4,397,687 | 8/1983 | Bye . | |
| 4,483,623 | 11/1984 | Eaton et al. | 366/247 |
| 4,936,688 | 6/1990 | Cornell | 366/325.93 |
| 5,199,788 | 4/1993 | Stallings | 366/247 |
| 5,251,979 | 10/1993 | Larsen | 366/248 |

*Primary Examiner*—Charles E. Cooley
*Attorney, Agent, or Firm*—Thomas Hooker, P.C.

[57] ABSTRACT

A mixer includes an elongate shaft having a U-shaped slot at one end and a mixer blade seated within the U-shaped slot extending to either side of the shaft. The mixer blade includes top and bottom beams extending to either side of the shaft with alternating convex and concave rungs of uniform width extending between the top and bottom beams. The top beams bottom beams and pairs of adjacent rungs define flow passages that vary in width from the top beam to the bottom beam.

6 Claims, 2 Drawing Sheets

MIXER WITH ALTERNATING SIZED FLOW PASSAGES

FIELD OF THE INVENTION

The invention relates to mixers for mixing paints, stains, epoxies, etc. and to disperse powdered materials like grout, plaster and cement when mixed with liquids.

BACKGROUND OF THE INVENTION

Paints, stains and the like are fluids with solids suspended in the fluid when properly mixed. When the fluid sits for an extended period of time, the solids tend to drop out of suspension and congregate on the bottom of the container. Before use, the solids must be re-mixed with the fluid to place them back in suspension.

Powdered materials like grout, plaster and cement are added to a liquid and mixed to create a fluid material. However, the powdered material forms lumps when added to the liquid and resists thorough mixing.

Conventional mixers require a lengthy amount of time in order to re-mix paints and the like. In addition, the quality of the mixing is frequently unsatisfactory. For example, conventional mixers that use a solid blade or paddle entrain unwanted air in the fluid because of the mixing by displacement. Conventional mixers also fail to rapidly and effectively circulate the fluid so that all the fluid comes in contact with the blade for mixing.

Conventional mixers with flow-through passages in the mixing blade have difficulty removing lumps and are slow in thoroughly mixing powdered materials with liquids to create fluids. Typically, lumps formed by the powdered material are repeatedly deflected off the conventional mixers without reducing the size or quantity of the lumps. In addition, conventional mixers have constant width flow-through which passages fail to reduce the size of lumps. These mixers do not generate desired turbulent mixing flows. Mixing times may be reduced as much as 50 to 80 percent over the mixing times using conventional mixers.

SUMMARY OF THE INVENTION

The present invention is an improved mixer comprising a shaft and a mixer blade. The mixer blade has a center portion mounted on the shaft and two like side portions. The portions include beams and rungs which define alternate narrow waisted and wide waisted mixing flow passages. The mixing flow passages provide openings for mixing fluids using induced turbulence created by the fluids passage through the openings. The problem of entraining unwanted air in the mixture is eliminated.

The mixer rapidly and efficiently mixes solids and fluids to form a uniform mixture. Mixing is enhanced by induced turbulence and breaking up of lumps without entraining air in the mixture.

The bottom of the mixer blade extends down to either side of the shaft at a shallow angle. The concave surface on the bottom of the blade creates a drawing action whereby fluid is drawn down the sides of a mixing container, through the path of the mixing blade, along the bottom towards the shaft, and upward along the shaft to the surface. This flow increases mixing efficiency.

The variance in width of the narrow waisted and wide waisted mixing flow passages increases the turbulence of the flow through the passages and efficiently breaks up lumps without disrupting the flow.

Other objects and features of the invention will become apparent as the description proceeds, especially when taken in conjunction with the accompanying drawings illustrating the invention, of which there are two sheets and one embodiment.

DESCRIPTION OF THE PREFERRED EMBODIMENT

Figure 1:
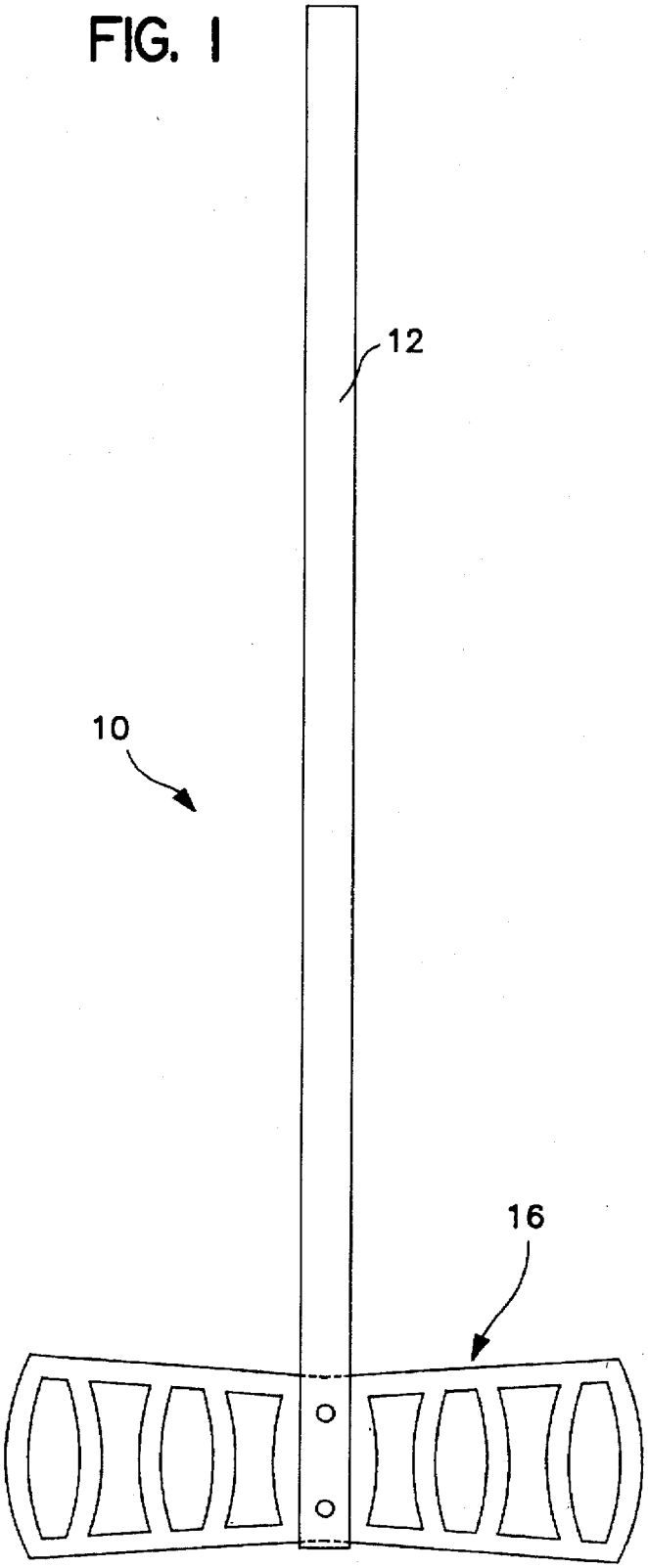
FIG. 1 is a front view of a mixer according to the invention.
Figure 2:
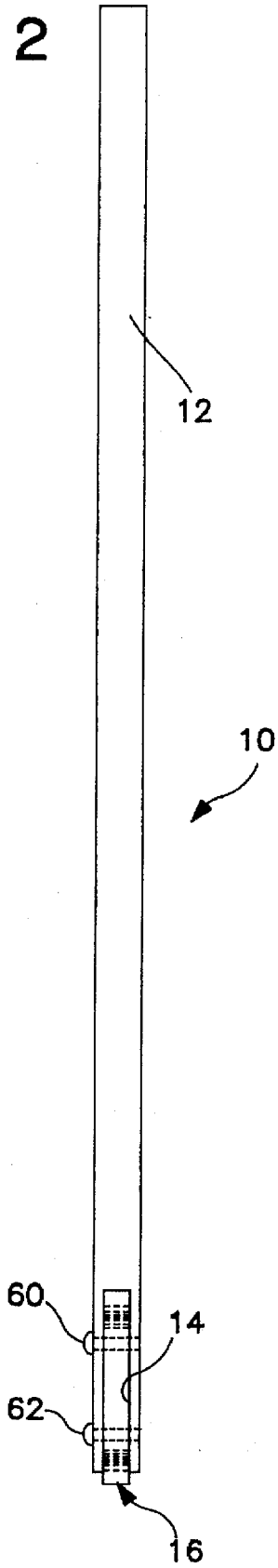
FIG. 2 is a side view of the mixer according to the invention.
Figure 3:
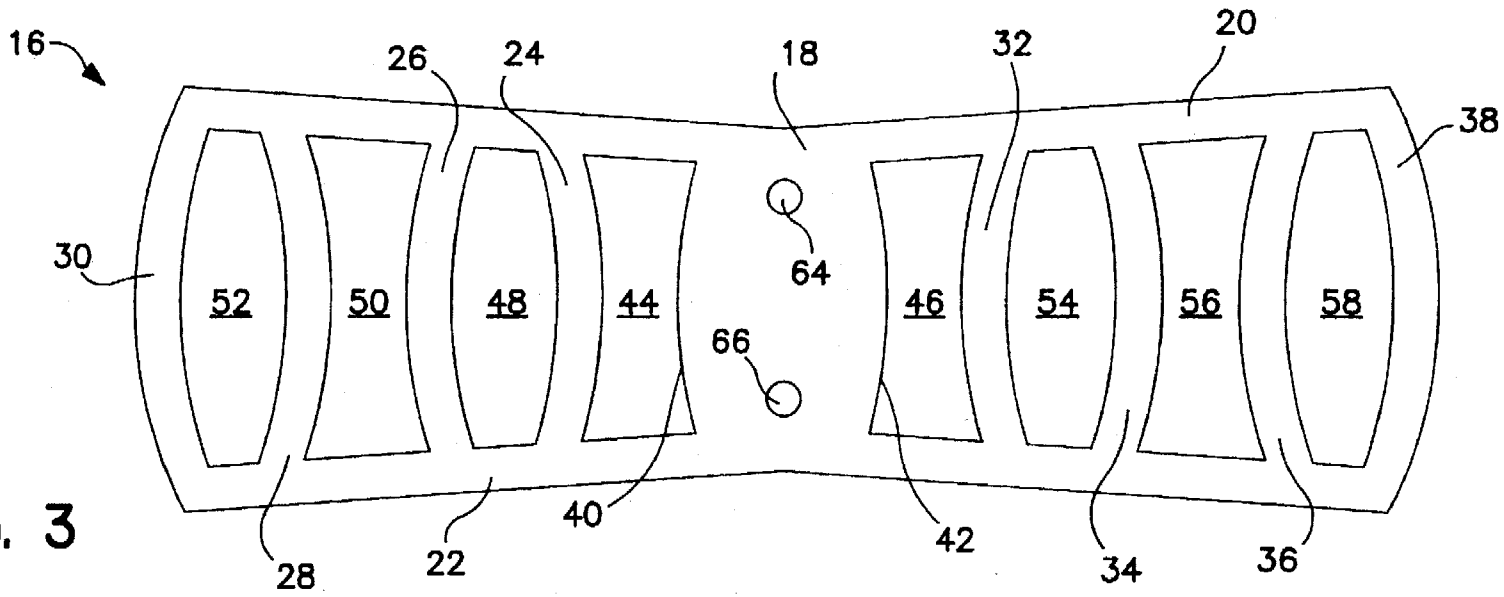
FIG. 3 is a perspective view of a mixer blade according to the invention.
Figure 4:
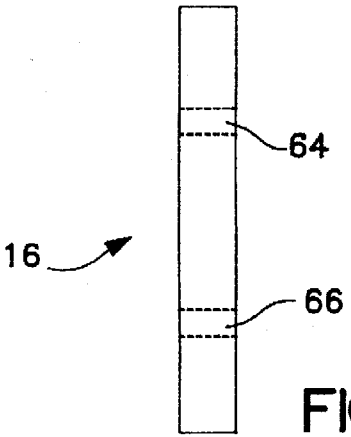
FIG. 4 is a side view of the mixer blade according to the invention.

Mixer 10 includes an elongate shaft 12 having a slot 14 at one end and a flat mixer blade 16 seated within slot 14 and extending to either side of the shaft 12, as shown in FIGS. 1 and 2. The blade includes two like sides and is symmetrical to either side of the shaft. As shown in FIGS. 3 and 4, mixer blade 16 includes a center portion 18 seated within the slot 14, a top beam 20 extending upwardly at a shallow angle to either side of shaft 12 from center portion 18, and a bottom beam 22 extending downwardly at a shallow angle to either side of shaft 12 from center portion 18. Mixer blade 16 includes a plurality of curved rungs 24, 26, 28, 30, 32, 34, 36 and 38, each extending between top beam 20 and bottom beam 22. The rungs are located on either side of center portion 18. The rungs on each side of center portion 18 extend between a pair of beams 20 and 22, and alternate between inwardly curved rungs 24 and 28, and 32 and 36 and outwardly curved rungs 26 and 30, and 34 and 38. Top beam 20, bottom beam 22, and rungs 24, 26, 28, 30, 34, 36 and 38 have a uniform width.

Center portion 18 extends through shaped slot 14 and is outwardly curved at surfaces 40 and 42 to either side of shaft 12 facing the adjacent inwardly curved rungs 24 and 32. Surface 40 and adjacent rung 24 define a flow-passage 44. Concave surface 42 and adjacent concave rung 32 define another flow-passage 46. In addition, pairs of adjacent rungs define further flow passages 48, 50, 52, 54, 56 and 58.

Flow passages 44, 46, 50 and 56 are defined by opposed, inwardly curved surfaces and are narrow waisted in shape. The width of the flow passages 44, 46, 50 and 56 is at a minimum about halfway between top beam 20 and bottom beam 22.

Flow passages 48, 52, 54 and 58 are defined by opposed, outwardly curved surfaces and are wide waisted in shape. These flow passages 48, 52, 54 and 58 have a maximum width halfway between top beam 20 and bottom beam 22.

Mixer blade 16 is secured to shaft 12 by threaded screws 60 and 62. Thread screw 60 and 62 are spaced apart along shaft 12 and extend from one side, through center portion 18 and U-shaped slot 14, along screw passages 64 and 66 respectively, to the other side of shaft 12. The blade may also be welded to the shaft. The mixer is easily and quickly cleaned, particularly if the blade is welded to the shaft.

The operation of mixer 10 will now be described. The free end of shaft 12 is attached to a mixing device (not illustrated) for rotation of mixer 10. Mixer blade 16 is then extended into a container of material to be mixed. Preferably, mixer 10 is inserted until mixer blade 16 is located adjacent to the bottom of the container. The mixing device is then activated to rotate mixer blade 16 through the material to be mixed. Mixer blade 16 rotates about the axis of shaft 12. As mixer blade 16 rotates about shaft 12, the flow passages 44, 46, 48, 50, 52, 54, 56 and 58 pass through the material to be mixed. The material to be mixed is forced through the flow passages. Forcing the material through the flow passages causes the material to undergo turbulent mixing and breaks up any large lumps in the solid material. The varying width of the flow passages increases the amount of turbulent mixing and the effectiveness of reducing the amount of lumps in the material.

Bottom beam 22 extends to either side of shaft 12 at a shallow downward angle. Rotation of the beam creates a concave surface on the bottom of mixer blade 16. As mixer blade 16 is rotated through the material, the concave surface defined by bottom beam 22 draws material inward and upward along shaft 12. As the material is drawn in towards the shaft then upwards along shaft 12, the displaced material is replaced by material that is drawn down the sides of the container towards to the bottom. The material drawn down the sides of the container encounters mixer blade 16 adjacent to the bottom of the container. The concave surface causes the solid and fluid material in the container to circulate freely and mix within the container. The increased circulation result in more efficient mixing. Increased exposure of the material to mixer blade 16 increases the speed and effectiveness of the mixing operation.

While I have illustrated and described a preferred embodiment of my invention, it is understood that this is capable of modification, and I therefore do not wish to be limited to the precise detail set forth, but desire to avail myself of such changes and alterations as fall within the preview of the following claims.

What I claim is:

1. A mixer for mixing material, comprising:

a) an elongate shaft;

b) a blade joined to said shaft extending to either side of said shaft;

c) said blade having a center portion, a top beam extending to either side of said center portion at an upward angle, a bottom beam spaced from said top beam extending to either side of said center portion at a downward angle, a plurality of rungs to either side of said center portion extending between said top beam and said bottom beam, adjacent rungs of said plurality of rungs defining a plurality of mixing openings between said top beam and said bottom beam, said plurality of rungs being alternately inwardly and outwardly curved with respect to said center portion.

2. The mixer as claimed in claim 1, wherein said shaft includes a slot at one end and said center portion is seated within said slot.

3. The mixer as claimed in claim 2, wherein said plurality of rungs includes four rungs to either side of said center portion.

4. The mixer as claimed in claim 3, wherein said center portion includes an outwardly curved surface on either side thereof and an adjacent rung of said plurality of rungs is inwardly curved to define a narrow waisted opening between said center portion and said adjacent rung on either side of said center portion.

5. A mixer comprising a mixer shaft and a generally flat blade on an end of the shaft, the blade including opposed and spaced apart pairs of beams extending outwardly from opposite sides of the shaft and a plurality of outwardly spaced rungs, each rung extending between a pair of the beams on one side of the shaft, the plurality of rungs on each side of the shaft being alternately outwardly and inwardly curved with respect to said shaft to define a plurality of alternating narrow waisted and wide waisted mixing openings extending through the blade and spaced along the blade outwardly from the mixer shaft.

6. A mixer as in claim 5, wherein the rungs are of equal width.

* * * * *